US007530295B2

(12) United States Patent
Jones et al.

(10) Patent No.: US 7,530,295 B2
(45) Date of Patent: May 12, 2009

(54) COMPACT SKATEBOARD TOOL

(76) Inventors: Aaron Jones, 80 Sunol St., San Jose, CA (US) 95126; Michael Knapton, 3391 N. 350 East, North Ogden, UT (US) 84414

( * ) Notice: Subject to any disclaimer, the term of this patent is extended or adjusted under 35 U.S.C. 154(b) by 0 days.

(21) Appl. No.: 12/006,393

(22) Filed: Jan. 2, 2008

(65) Prior Publication Data

US 2008/0163434 A1 Jul. 10, 2008

Related U.S. Application Data

(60) Provisional application No. 60/878,742, filed on Jan. 4, 2007.

(51) Int. Cl.
*B25B 13/00* (2006.01)

(52) U.S. Cl. ..... 81/124.4; 81/124.5; 81/125.1; 81/177.6; 81/437; 81/440

(58) Field of Classification Search ..... 81/124.3–124.5, 81/125.1, 177.6, 437–440; 7/165
See application file for complete search history.

(56) References Cited

U.S. PATENT DOCUMENTS 496,913 A * 5/1893 Shoe ..... 81/119
849,891 A * 4/1907 Ellington ..... 81/120
1,001,280 A * 8/1911 Keller ..... 81/119
1,321,777 A * 11/1919 Stepanian ..... 81/165
1,369,829 A * 3/1921 Minges ..... 81/125.1
1,402,391 A * 1/1922 Baldus ..... 7/128
1,981,048 A * 11/1934 Keller ..... 30/363
2,083,131 A * 6/1937 Tornebohm ..... 206/376
2,394,845 A * 2/1946 Cothern ..... 7/168
2,697,371 A * 12/1954 Bowman ..... 81/125.1
D243,506 S 3/1977 Hess
4,408,505 A * 10/1983 Cook ..... 81/98
4,532,834 A * 8/1985 Hartman ..... 81/16
4,774,736 A 10/1988 Brawner et al.
4,926,721 A 5/1990 Hsiao
5,259,281 A * 11/1993 Burke ..... 81/437
5,285,543 A 2/1994 Rowe
5,365,811 A 11/1994 Chi
D356,240 S * 3/1995 Meldahl ..... D8/105
5,524,513 A 6/1996 Barahona
D393,578 S * 4/1998 Keddie ..... D8/17
5,778,896 A 7/1998 Seals et al.
5,910,174 A * 6/1999 Finn ..... 7/127
5,983,760 A 11/1999 Clarke
6,062,111 A 5/2000 Wershe
6,131,494 A * 10/2000 Quenneville ..... 81/125.1
6,279,434 B1 8/2001 Brown (Continued)

*Primary Examiner*—D. S Meislin
(74) *Attorney, Agent, or Firm*—Erik V Chmelar

(57) ABSTRACT

A multipurpose skateboard tool comprising two separable substantially flat elongated members and a separable chain. The first substantially flat elongated member comprises a socket within one end, a wrench within the opposite end, and a keyway and at least one through hole within the middle portion. The second substantially flat elongated member comprises a wrench within one end, a screwdriver bit on the opposite end, and a rivet and at least one through hole within the middle portion. The two substantially flat elongated members may interlock together via the keyway and rivet mechanism for compact and flat storage. When interlocked, the chain may be inserted through adjacent through holes to prevent separation of the two substantially flat elongated members.

6 Claims, 3 Drawing Sheets

U.S. PATENT DOCUMENTS 6,286,397 B1 9/2001 Taggart et al.
D490,284 S 5/2004 McElligott et al.
7,182,000 B1 * 2/2007 Dicksen ..... 81/177.2
7,204,176 B2 * 4/2007 Wu ..... 81/177.7
7,293,312 B2 11/2007 Chmelar
2003/0066392 A1 * 4/2003 Hsien ..... 81/124.5

* cited by examiner

COMPACT SKATEBOARD TOOL

This application claims the benefit of U.S. Provisional Patent Application No. 60/878,742, filed Jan. 4, 2007 by Aaron Jones and Michael Knapton.

BACKGROUND OF THE INVENTION

The present invention relates generally to a multipurpose tool, such tool comprising two substantially flat elongated members that may interlock together for compact storage and transport, wherein each tool member includes a plurality of tool elements for adjustment, assembly, or repair of skateboards, inline skates, bicycles, or any other equipment suitable to receive any of the tool elements.

For example, assembly, adjustment, or repair of a typical skateboard may require a ⅜ inch socket or wrench, a ½ inch socket or wrench, a 9/16 inch socket or wrench, and a screwdriver with a Phillips or Allen head. A sporting enthusiast would prefer to have a compact multipurpose tool to assemble, adjust, or repair his or her equipment instead of either a large and bulky multipurpose tool or a plurality of separate tools. Consequently, there have been many attempts at developing multipurpose tools that incorporate several tools in a compact form.

U.S. Pat. No. 7,293,312, (Chmelar), U.S. Pat. No. D490,284 (McElligott, et. al.), and U.S. Pat. No. 5,524,513 (Barahona) disclose compact multipurpose skateboard tools that are generally cylindrical in shape.

U.S. Pat. No. 6,286,397 (Taggart, et. al.), U.S. Pat. No. 6,062,111 (Wershe), and U.S. Pat. No. 4,774,736 (Brawner, et. al.) disclose multipurpose skateboard tools that consist of a housing to store a plurality of separate tool pieces.

U.S. Pat. No. 6,279,434 (Brown), U.S. Pat. No. 5,983,760 (Clarke), U.S. Pat. No. 5,778,896 (Seals, et. al.), U.S. Pat. No. 5,365,811 (Chi), U.S. Pat. No. 5,285,543 (Rowe), U.S. Pat. No. 4,926,721 (Hsiao), and U.S. Pat. No. D243,506 (Hess) disclose multipurpose skateboard tools that are generally "T," "L", or "X" in shape.

Many of the previous multipurpose tools do not include a sufficient number of the tools that may be required for assembly, adjustment, or repair of the user's equipment. Additionally, many of the previous multipurpose tools can be bulky and awkward to carry, often shaped as a non-compact "T" or "X." Although multipurpose tools shaped as a cylinder are less bulky to transport, they may still be cumbersome when carried in a pants pocket. Furthermore, many of the previous multipurpose tools include a very small removable Phillips or Allen key that can be difficult to use and easy to lose. Finally, many of the previous multipurpose tools include swiveling or pivoting parts that may be susceptible to damage or breakage.

Accordingly, what is desired, and has not heretofore been developed, is a multipurpose tool that incorporates a sufficient number of the tool elements that may be required for assembly, adjustment, or repair of equipment such as a skateboard, is compact and generally flat in shape to facilitate convenient carrying in a pocket, is devoid of swiveling or pivoting parts that may be prone to damage or breakage, and is devoid of very small detachable Phillips or Allen keys that may be difficult to use and easy to lose.

BRIEF SUMMARY OF THE INVENTION

It is an object of the present invention to provide a multipurpose tool that comprises two substantially flat members that may interlock together for compact storage.

It is an object of the present invention to provide a multipurpose tool wherein each substantially flat member includes a plurality of tool elements for adjustment, assembly, or repair of skateboards, inline skates, bicycles, or any other equipment suitable to receive any of the tool elements.

It is an object of the present invention to provide a multipurpose tool that is easy to use.

It is an object of the present invention to provide a multipurpose tool that is inexpensive to manufacture.

DETAILED DESCRIPTION OF THE INVENTION

Figure 1A:
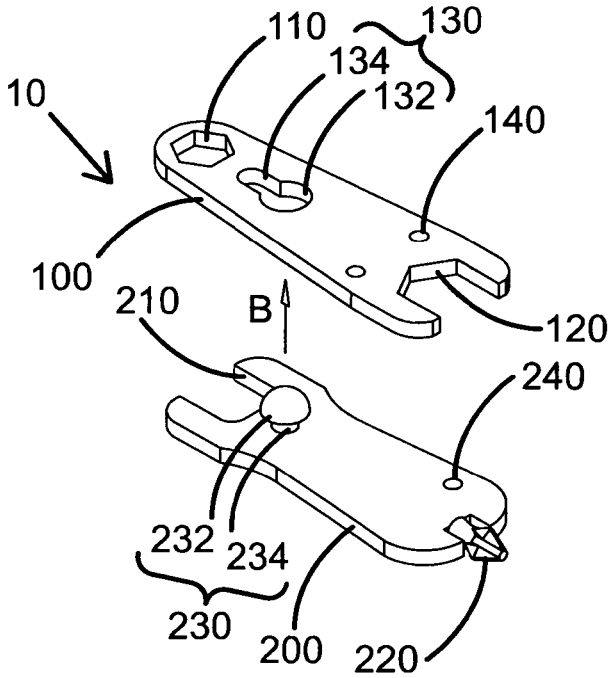
FIG. 1*a* is a perspective view of the first and second flat elongated members of the multipurpose tool.

FIG. 1*a* shows the multipurpose tool 10 with the first flat member 100 and second flat member 200 separated for use. The first flat member 100 includes a socket 110 defined on a first end and a wrench 120 defined on a second end opposite said first end. Alternatively, the socket 110 may be an open-ended wrench rather than an enclosed socket. Heretofore the term "wrench" is used to describe an open-ended tool element that may communicate with a hexagonal nut or bolt head. Heretofore the term "socket" is used to describe an enclosed tool element that may communicate with a hexagonal nut or bolt head.

Figure 1B:
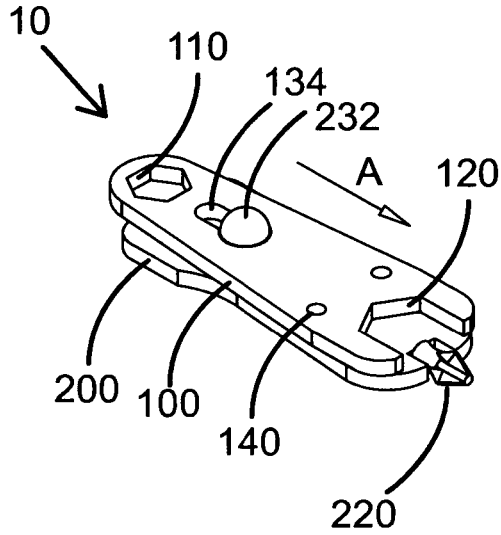
FIG. 1*b* is a perspective view of first and second flat elongated members with the rivet head inserted through the keyway opening.
Figure 1C:
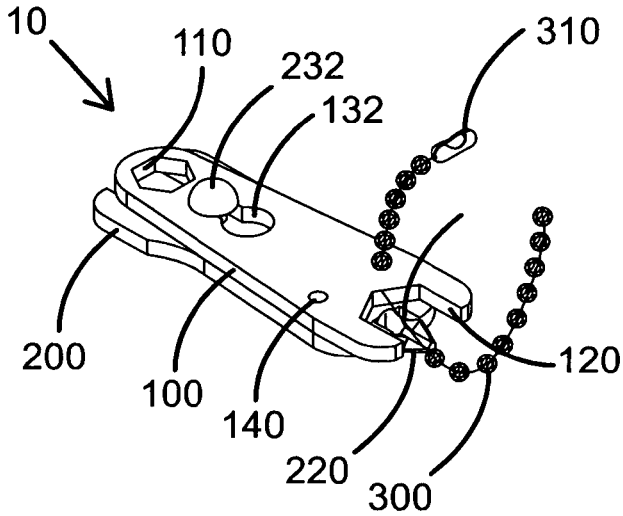
FIG. 1*c* is a perspective view of the first and second flat elongated members secured together via the rivet and keyway mechanism and with a chain inserted through adjacent through holes therein.

Defined within a middle portion of the first flat member 100 adjacent to the wrench 120 is a pair of through holes 140. Defined within the second flat member 200 is a similar through hole 240 which lines up with one of the through holes 140 when the first flat member 100 and second flat member 200 rest flat against each other with the rivet 230 and keyway 130 mechanism engaged as shown in FIG. 1*c*.

Alternatively, a plurality of through holes 240 may be defined within the second flat member 200 and only one through hole 140 may be defined within the first flat member 100 or a plurality of through holes 140 may be defined within the first flat member 100 and a plurality of through holes 240 may be defined within the second flat member 200. In all three above-described configurations of through holes 140 and through holes 240, at least one through hole 140 will line up with one through hole 240 regardless of the upright or inverted orientation of the first flat member 100 when the rivet 230 and keyway 130 mechanism is engaged. Also alternatively, only one through hole 140 may be defined within the first flat member 100 and only one through hole 240 may be defined within the second flat member 200. If the single through hole 140 and single through hole 240 are centered within the first flat member 100 and second flat member 200, respectively, they will also line up regardless of the upright or inverted orientation of the first flat member 100 when the rivet 230 and keyway 130 mechanism is engaged.

The second flat member 200 includes a wrench 210 on a first end and a screwdriver bit 220 on a second end opposite said first end. Although the screwdriver bit 220 is shown with a Phillips head, it may include any type or style of head, such as an Allen, Phillips, flat, Torx, star, square, triangular, etc.

A keyway 130, comprising a large keyway opening 132 and a small keyway channel 134, is defined on a middle portion of the first flat member 100 adjacent to the socket 110. Although the keyway 130 is shown oriented with the keyway channel 134 adjacent to the socket 110, the keyway 130 may alternatively be oriented with the keyway channel 134 facing away from the socket 110 and the keyway opening 132 adjacent to the socket 110. A rivet 230, comprising a large rivet head 232 with a diameter smaller than the keyway opening 132 and larger than the keyway channel 134 and a small rivet shank 234 with a diameter smaller than the keyway channel 134, is defined on a middle portion of the second flat member 200 adjacent to the wrench 210.

Although the multipurpose tool 10 is shown with keyway 130 adjacent to socket 110 and through holes 140 adjacent to wrench 120 within the first flat member 100 and rivet 230 adjacent to wrench 210 and through hole 240 adjacent to screwdriver bit 220 in the second flat member 200, the multipurpose tool 10 may alternatively be constructed with keyway 130 adjacent to wrench 120 and through holes 140 adjacent to socket 110 in the first flat member 100 and rivet 230 adjacent to screwdriver bit 220 and through hole 240 adjacent to wrench 210 in the second flat member 200. In this alternative construction, the keyway 130 may either be oriented with keyway opening 132 or keyway channel 134 adjacent to wrench 120.

The rivet 230 communicates with the keyway 130 to interlock the first flat member 100 to the second flat member 200. The rivet head 232 may be inserted through the keyway opening 132 in the direction B indicated in FIG. 1*a* and the first flat member 100 is moved along the second flat member 200 longitudinally in the direction A indicated in FIG. 1*b* until the rivet shank 234 is adjacent to the keyway channel 134.

Once the first flat member 100 and second flat member 200 are interlocked via the rivet 230 communicating with the keyway 130, a chain 300 may be inserted through the through hole 240 and the adjacent through hole 140 to prevent the first flat member 100 and second flat member 200 from separating. Heretofore the term "chain" is used to describe any element capable of being inserted though the through hole 140 and either of the through holes 240, such as a chain, string, wire, or split ring. The chain 300 may include a clasp 310 to secure the two ends of the chain 300 together.

When the first flat member 100 and second flat member 200 are interlocked as shown in FIG. 1*c*, the screwdriver bit 220 is adjacent to the wrench 120 and occupies a portion of the empty space within the wrench 120 to permit the first flat member 100 and second flat member 200 to lay flat against each other if the width of the screwdriver bit 220 extends beyond the flat periphery of the second flat member 200.

Figure 2A:
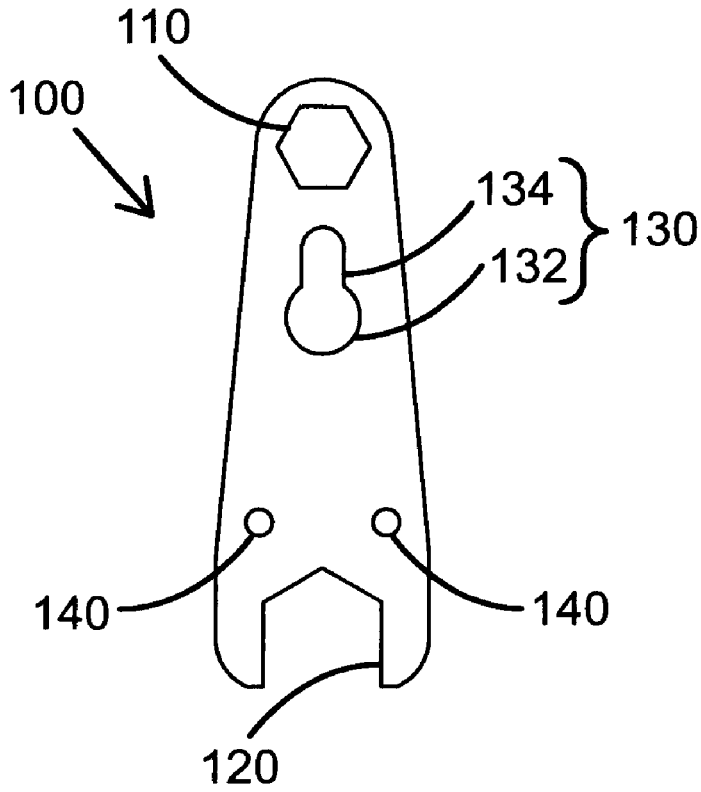
FIG. 2*a* and FIG. 2*b* are top elevation and side elevation views of the first flat elongated member, respectively.
Figure 2B:
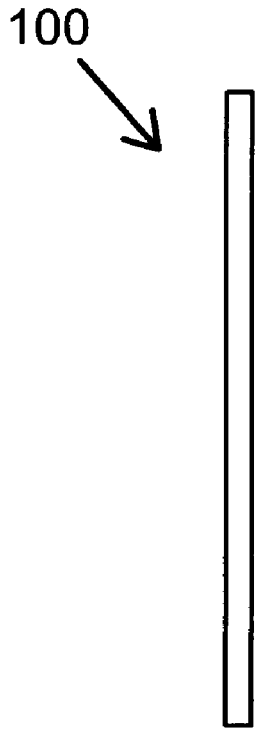

FIG. 2*a* shows a top elevation view of the first flat member 100 and FIG. 2*b* shows a side elevation view of the first flat member 100. The flatness of the first flat member 100 can be seen in FIG. 2*b*.

Figure 3A:
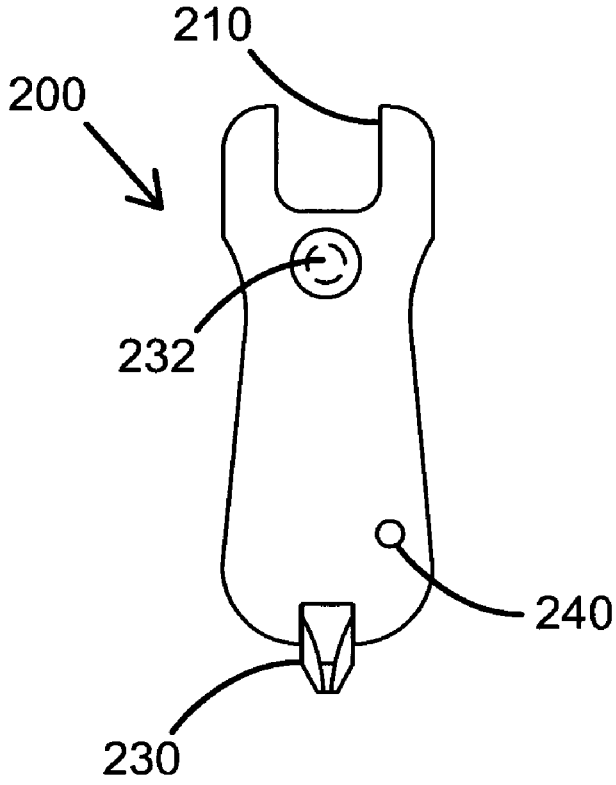
FIG. 3*a* and FIG. 3*b* are top elevation and side elevation views of the second flat elongated member, respectively.
Figure 3B:
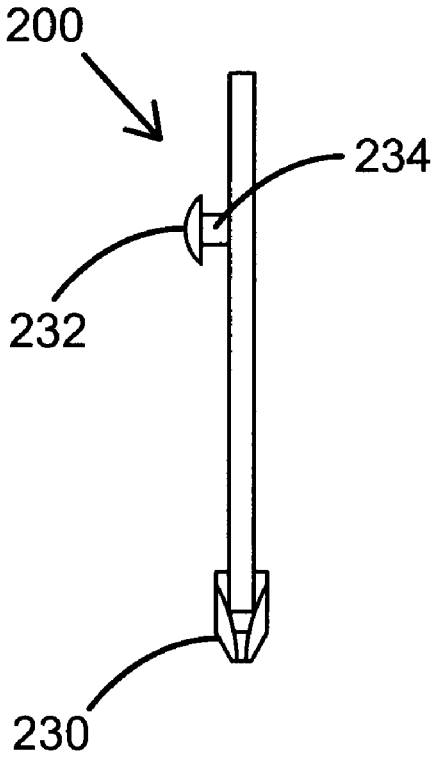

FIG. 3*a* shows a top elevation view of the second flat member 200 and FIG. 3*b* shows a side elevation view of the second flat member 200. The flatness of the second flat member 200 can be seen in FIG. 3*b*.

What is claimed is:

1. A multipurpose tool comprising:

a first substantially flat elongated member defining a first end, a middle portion, and a second end opposite said first end, said first substantially flat elongated member including a socket defined within said first end, a wrench defined within said second end, a keyway defined within said middle portion, said keyway including a keyway opening and a keyway channel, said keyway opening diameter larger than said keyway channel width, and at least one through hole defined within said middle portion;

a second substantially flat elongated member defining a first end, a middle portion, and a second end opposite said first end, said second substantially flat elongated member including a wrench defined within said first end, a screwdriver bit extending longitudinally from said second end, a rivet defined on said middle portion, said rivet comprising a rivet shank extending perpendicularly from the plane of said second substantially flat elongated member and a rivet head on the distal end of said rivet shank, said rivet head diameter smaller than said keyway opening diameter and larger than said keyway channel width, and said rivet shank diameter smaller than said keyway channel width, and at least one through hole defined within said middle portion; and a chain with diameter smaller than said through holes of said first and second substantially flat elongated members.

2. The tool of claim 1 wherein said chain includes a clasp.

3. The tool of claim 1 wherein said screwdriver bit defines a Phillips head.

4. The tool of claim 1 wherein said screwdriver bit defines a flat head.

5. The tool of claim 1 wherein said screwdriver bit defines an Allen head.

6. The tool of claim 1 wherein said screwdriver bit defines a Torx head.

* * * * *